United States Patent [19]

Justice

[11] 4,037,875

[45] July 26, 1977

[54] FULL FACE MINER

[75] Inventor: James Conley Justice, Beckley, W. Va.

[73] Assignee: Coaltex, Inc., Beckley, W. Va.

[21] Appl. No.: 698,123

[22] Filed: June 21, 1976

[51] Int. Cl.[2] ..... E21C 27/24

[52] U.S. Cl. ..... 299/31; 299/11; 299/12; 299/18; 299/33

[58] Field of Search ..... 299/11, 12, 31, 33, 299/43–46, 51, 52, 64, 71

[56] References Cited

U.S. PATENT DOCUMENTS

| | | | |
|---|---|---|---|
| 3,418,023 | 12/1968 | Webster | 299/43 |
| 3,640,580 | 2/1972 | White | 299/31 |
| 3,813,126 | 5/1974 | Rogne et al. | 299/12 X |
| 3,879,088 | 4/1975 | Sodder et al. | 299/31 |

FOREIGN PATENT DOCUMENTS

| | | | |
|---|---|---|---|
| 2,050,618 | 4/1972 | Germany | 299/64 |
| 1,047,472 | 11/1966 | United Kingdom | 299/43 |

*Primary Examiner*—Ernest R. Purser
*Attorney, Agent, or Firm*—Cushman, Darby & Cushman

[57] ABSTRACT

A miner especially adapted for high-production mining of low-coal seams (24–36 inches thick) while providing maximum miner safety and complying with applicable federal safety regulations. One or more cutting heads rotatable about the vertical axes are provided along with electric motors for rotating the heads. The heads are mounted for reciprocal longitudinal movement along the cutting face, and hydraulic cylinders, or the like, are provided for reciprocating the heads so that they move toward each other during shearing. A paddle-type conveyor continuously (even during sumping) conveys the cut coal away from the coal face, substantially perpendicular thereto through the formed tunnel. Hydraulic rams associated with roof-supporting and anchoring means are provided for sumping the cutting heads. A curtain assembly or the like contains the dust generated during cutting to a confined area adjacent the cutting face, and an exhaust fan or fans continuously draws the dust away from the confined area. Portions of the roof supports extend into the confined area in order to provide maximum support for the roof during cutting.

16 Claims, 6 Drawing Figures

FULL FACE MINER

BACKGROUND AND SUMMARY OF THE INVENTION

The invention relates to a miner especially adapted for high-production mining of low-coal seams (24–36 inches thick) while providing maximum miner safety and complying with applicable federal regulations, however, the miner may be used for mining thicker coal seams.

In the past, there have been problems associated with low-coal seam mining that have made high production mining difficult, such problems including proper roof supports, good cutting action of the cutting means, effective conveyance of the cut coal away from the cutting face, and proper dust control in the cutting area. While there have been recent proposals (such as shown in U.S. Pat. Nos. 3,640,580 and 3,784,256) for effecting dust control in seam mining in general, the prior proposed structures have been relatively complicated, too large and expensive, and the problems of proper roof support, good cutting action for effective high-production mining in low coal seams, and effective conveyance of coal away from the cutting face have not been entirely solved.

According to the present invention, a full face miner for mining coal or the like (especially in low seams) has been provided, including one or more cutting heads that are rotatable about vertical axes, the rotation about vertical axes providing effective cutting action, and an accessory cutting member is provided with each cutting head for providing slight adjustment of the height of the fact that is to be cut. Means are provided for rotating the cutting heads about their vertical axes — so that the cutting heads rotate inwardly toward each other — and means are provided for mounting the cutting heads for reciprocal longitudinal movement toward and away from each other along the cutting face. Means are provided for moving the cutting heads on the mounting means in the reciprocal longitudinal movement so that the cutting heads may move toward or away from each other to effect shearing so that the cut coal is continuously conveyed away by a paddle-type conveyor or the like. The conveyor moves the cut coal toward a midpoint of the cutting face and then conveys the coal away from the cutting face substantially perpendicular thereto.

Such conveying action allows conveyance of the coal away from the mined area though the tunnel already formed by the miner and it is not necessary to provide any communication between the ends of the face and accessory-conveying means, as is necessary in forms of conventional long-wall mining. The width of the cutting face established according to the present invention is only about 16–30 feet, the conveying means effectively carrying away the coal cut along this relatively narrow face.

Means for supporting the roof and for anchoring the mounting means in stationary position during cutting are provided which allow for maximum flexibility in the movement (advancement) of the miner, while providing roof support as close to the cutting action as possible. Such means preferably include a plurality of vertically-adjustable rams. The rams have elongated top portions thereof which extend to a point close to the cutting face, and within an established dust control area (as opposed to the prior art). Means are also provided for sumping (advancing) the cutting heads when they are disposed in their initial (or any other) positions. The sumping means preferably includes a plurality of horizontally-adjustable rams associated with selected ones of said vertical rams, hydraulic control means being provided for the vertically and horizontally-adjustable rams so that quick advancement of the cutting heads takes place while proper roof support is always provided. Means associated with the supporting means are provided for substantially containing dust generated by cutting into a confined area adjacent the face. As mentioned previously, the supporting means have a portion thereof which preferably is within the confined area and means are provided for exhausting the dust from the confined area to the area for safe disposal thereof.

The dust-containing means preferably includes a curtain assembly including a rubber flap or the like sealing a metal plate(s) or the like with the roof. All the dust in the confined area during cutting is effectively contained therein by the metal plate(s) and its rubber seal. An exhaust fan(s) or the like is mounted in the curtain plate portion of the assembly for drawing the dust through the confined area along the cutting face at a volume rate adequate to provide dust control and face ventilation. Also, a water spray may be provided in the confined area for facilitating dust control and water for the water spray may be provided by cooling water cooperating with electric motors that provide the means for rotating the cutting heads to effect proper cutting.

Collapse of the tunnel in back of the miner is prevented by placing suitable roof supports in back of the miner after each intermittent advancement of the miner by the supporting and sumping means.

It is the primary object of the present invention to provide an improved full face miner, one especially adapted for use in low coal seam mining and one that insures miner safety and complies with applicable federal requirements. This and other objects of the invention will become clear from an inspection of the detailed description of the invention and the appended claims.

DETAILED DESCRIPTION OF THE INVENTION

Figure 1:
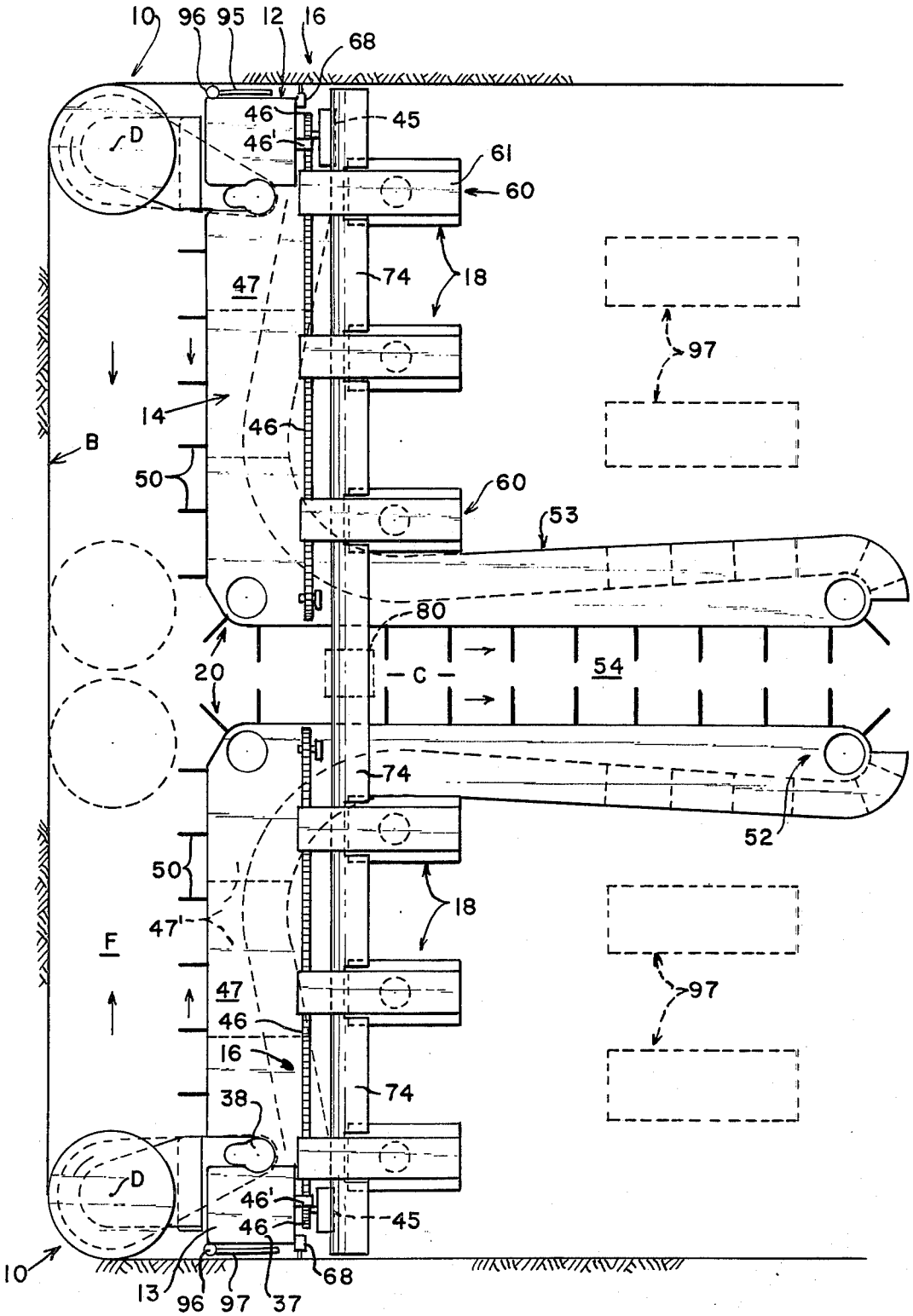
FIG. 1 is a top plan view diagrammatically showing an exemplary full face miner according to the present invention with parts thereof cut away for clarity.

A full-face miner for mining coal, ore and the like in a seam A from a face B thereof is shown diagrammatically in the drawings. The miner includes one or more cutting heads 10, each rotatable about a vertical axis D—D, the vertical axes D—D being parallel to each other and longitudinally spaced from each other along the face B, and means 12 for rotating each of the cutting therewith. Mounting means 14 are provided for mounting said cutting heads 10 for reciprocal longitudinal movement toward and away from each other to effect shearing along the face B and means 16 are provided for moving the cutting heads 10 on said mounting means 14 to effect shearing. Roof E (see FIG. 2) supporting means 18 — which also provide for anchoring of the mounting means 14 during shearing — are located as close to the cutting heads 10 as possible in order to provide proper support of the roof E. Conveying means 20 convey cut coal, or the like, from the face A, through a passage C, to an area remote from the cutting face. Means 22 (FIG. 2) are provided for sumping (advancing toward face B) the cutting heads 10 and means 24 and 26 (see FIG. 4) are provided to effect dust control, the means 24 including means associated with the supporting means 18 for substantially containing dust generated by cutting in a confined area F adjacent the cutting face B, and means 26 comprising means means for exhausting dust from the confined area F to an area for safe disposal of the dust. At least a portion of said supporting means 18 preferably is within confined area F.

While the term "coal" will be used throughout the specification and claims for indicating material mined according to the present invention, the term coal should be interpreted to cover coal, ore and the like, the invention not being restricted to coal per se.

Each of the cutting heads 10 will preferably include a shaft 30 that is rotatable about vertical axis D—D, a cutting drum 31 mounted for rotation with the shaft 30 and having teeth 32 formed on the periphery thereof and a drive chain 33 for rotating the drum 31 and shaft 30. Preferably, a cutting member 34 is also provided with each cutting head 10. The cutting member 34 is mounted on a vertically extendable shaft portion 35. The cutting member 34 may be in a first position wherein bottom surface 36 thereof substantially abuts drum 31, or in a second position (shown in dotted line in FIG. 2) wherein the lower edge 36 thereof is vertically spaced from the drum 31 whereby adjustment of the height of the face B that is being cut is provided. The adjustment in height provided by the cutting member is relatively small — i.e., 2 to 9 inches. The vertical adjustment provided thereby is especially useful, however, when the mining machine, according to the present invention, is utilized for cutting low coal seams — that is, coal in seams 24–36 inches thick — which is a primary use of the miner according to the present invention. At the present time, low coal is the hardest to mine; however, with the miner of the present invention, no special difficulties are encountered in mining low coal as opposed to any other coal seam. The miner of the invention is not restricted to low coal mining, however.

The means 12 for rotating the cutting heads about their vertical axes for effecting cutting preferably comprise an electric motor 37 associated with each cutting head 10. A drive sprocket 38, driven by electric motor 37, rotates the drum 31 and shaft 30 through chain 33. Power may be supplied to the electric motor by cables (not shown) trailing behind the mining machine and connected to a remote source of electrical energy. An electric motor 37 is especially useful for rotating the cutting head 10 since power is easily supplied thereto, since no fumes or the like are generated thereby, and since it is compact and safe. The shaft 30 is mounted for rotation about the vertical axis D-D by one or more horizontally-extending arms 39 attached to the casing for the electric motor 37. A discontinuity in the drum surface 31 is provided at each supporting arm 39.

Figure 3:
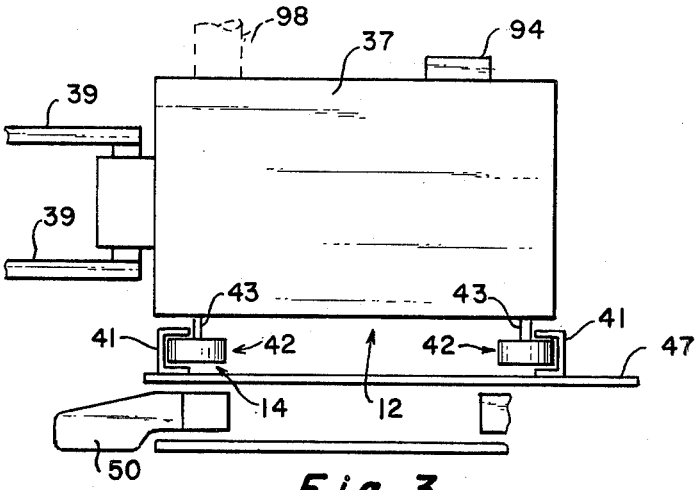
FIG. 3 is a detailed view showing exemplary means associated with the miner of FIG. 1, for mounting the cutting heads for reciprocal longitudinal movement.

The means 14 for mounting the cutting heads for reciprocal longitudinal movement toward and away from each other to effect shearing are shown only generally in FIG. 1, the means 14 being able to assume a wide variety of forms. One such form is shown in detail in FIG. 3, and means 14 therein comprising a pair of guide tracks 41 extending parallel to the face B and adapted to receive wheels 42 therein. The wheels 42 are of relatively hard material and are mounted for free rotation about the vertical axle 43 mounted to a casing for the electric motor 37. The tracks 41 and wheels 42 preferably are made of relatively friction-free material.

Figure 2:
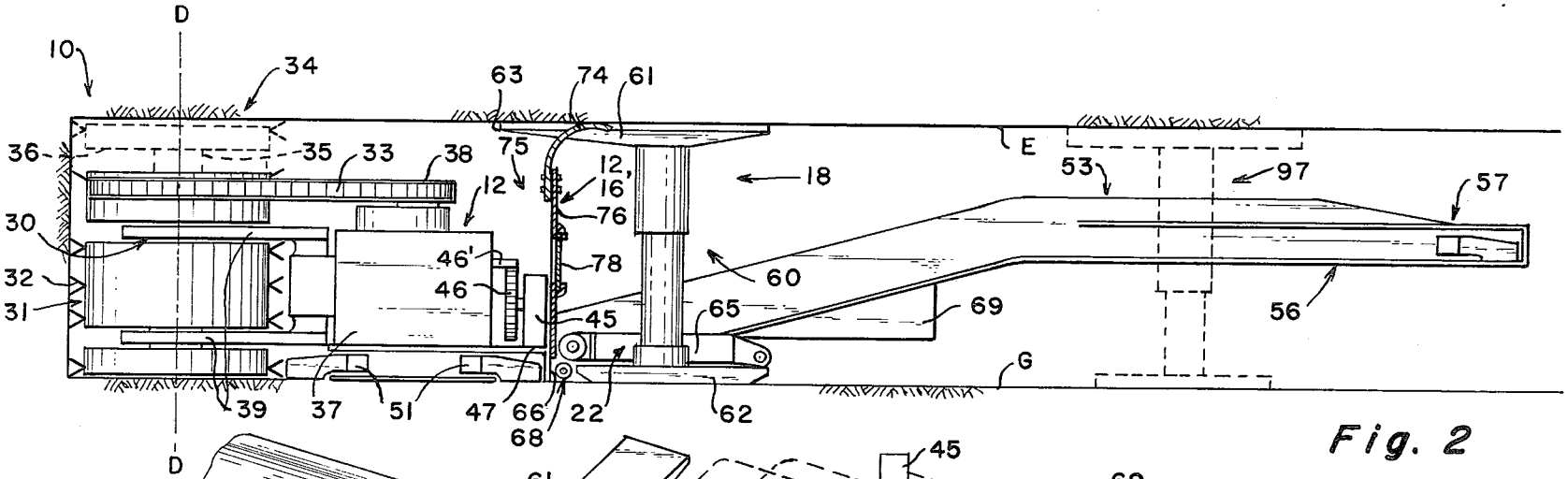
FIG. 2 is a side view of the miner of FIG. 1.

The means 16 for moving the cutting heads 10 on the mounting means 14 in reciprocal longitudinal movement, so that the cutting heads 10 are initially spaced a maximum distance from each other (shown in solid line in FIG. 1) when shearing is initiated, and then move toward each other to effect shearing (to the dotted line position shown in FIG. 1), may also take a wide variety of forms. As shown in FIGS. 1 and 2, the reciprocating means 16 comprises a pair of hydraulic motors 45 connected to sprockets for driving chains 46, and mounted on a platform 47, the casings of the electric motors 37 being connected to the chains 46 as by connecting brackets 46'. Rotation of the sprockets by motors 45 results in driving of the chains 46 to effect reciprocation of the motors 37, The shearing action takes place with the cutting heads 10 either moving toward or away from each other. Hydraulic motors 45 are believed to be especially useful since the pumps, hydraulic fluid lines, etc. therefore can be mounted directly on portions of the miner. The platform 47 for supporting the hydraulic motors 45 additionally provides the support for the guiding tracks 41, and additionally forms a top containment for the conveying means 20. The platform 47 may be disposed in sections 47' which may be connected together to provide a cutting face A of any desired width (chains 46 may similarly be adjusted in length).

The conveying means 20 preferably comprises a pair of paddle-type conveyors, having paddles 50 associated therewith and engaging the floor G of the coal seam being mined. Each of the paddles 50 are preferably mounted on a continuous chain (shown diagrammatically at 51 in FIG. 2) which is driven by a suitable power source 52. The paddles 50 are moved by the power source 52 so that coal cut from face B is engaged by paddles 50 and moved toward the center conveyance passageway C formed between the conveyor chains 51,51. The upper portion of the conveying means 14 is terminated by the plate 47 for that portion of the conveying means 14 located adjacent the face B. However, a chute structure 53 is provided leading from the front portion of the passageway C away from the face B ultimately to a further conveying means (not shown). A floor 54 is provided for the chute means 53. The floor 54 of chute means 53 substantially engages the floor G of the coal seam at the portion 55 thereof (see FIG. 4) located closest to the face B. The floor 54 slopes upwardly from the point 55 to a rear substantially-horizontal portion 56 of the chute means 53. Any other type of suitable conveying means may be disposed at the rear terminal portion 57 of the conveying means 14 (chute 53) for conveying the coal away from the mined area, such as a conveyor belt.

The pair of paddle-type conveyors, according to the present invention, are especially suitable since the cut coal can be quickly and efficiently moved thereby with a minimum amount of power away from the cutting face to a remote area, yet very little space is taken up thereby. The space-saving features of the conveyor, according to the present invention, are especially important since the miner of the invention is specially adapted to mine low coal seams (24–36 inches thick). The conveyors 20 continuously operate to convey coal from face B, even during sumping.

It is important in mining coal in all seams that the roof of the seam be supported as close to the cutting area as is possible and this is accomplished according to the present invention, even when dust control means are provided. The roof E supporting means 18, according to the present invention, include a plurality of vertically-adjustable hydraulic rams 60 having elongated portions 61 and 62 at the tops and bottoms thereof, respectively. The leading edges 63 of the upper elongated portion 61 are disposed as close as possible to the cutting heads 10 for providing their supporting function. Additionally, the rams 60 and associated structure anchor the mounting means 14 during reciprocal movement of the cutting heads 10 and provide anchoring support for the sumping means 22.

The sumping means 22 preferably includes a plurality of horizontally-adjustable rams 65 mounted on lower elongated portions 62 of selected vertical rams 60. The rams 65 are stationarily mounted to the elongated portion 62 and are also mounted — as by connection 66 (see FIG. 2) — to the platform 47 supporting the mounting means 14 and defining the upper portion of the conveying means 20. While a horizontally-adjustable ram 65 may be provided with each of the vertically-adjustable rams 60, according to the preferred embodiment of the present invention only selected ones of the vertical ram 60 (hereinafter designated "first vertical rams 60") have horizontally-adjustable rams 65 associated therewith while other vertically-adjustable rams (hereinafter designated "second vertical rams 60'") have a generally rigid horizontal connection between them and the mounting means, as shown best with reference to FIG. 4. A rigid metal bracket 67 (or spring-loaded arm) may be provided mounted to an elongated bottom portion 62 of a second vertical ram 60' and similarly mounted to platform 47. Hydraulic control means — shown diagrammatically at 69 in FIG. 4 — are provided for controlling the flow of hydraulic fluid to rams 60, 60', and 65 to effect the supporting, sumping, and anchoring functions of the rams 60, 60', 65.

Rib jacks 68 may be provided on each end of the miner, preferably attached to platform 47 (or curtain assembly 75), to facilitate the sliding of the miner along the sides of the seam during sumping, to facilitate support of the miner during shearing, and/or to facilitate side-to-side movement of the miner. Suitable hydraulic lines may be provided for the rib jacks 68.

The control means 69 control the rams 60, 60', and 65 so that the second vertical rams 60' are retracted (the elongated supporting portions 61 thereof are out of engagement with the roof E), and the horizontal rams 65 are extended while the first vertical rams 60 remain extended (in engagement with roof E) in an anchoring position to provide advancement (sumping) of the cutting heads a given distance, determined by the amount of horizontal extension of the rams 65. Since the second vertical rams 60' are rigidly connected to the mounting means 14, they are advanced relative to the first vertical rams 60 with the rest of the miner during sumping by horizontal rams 65. The second vertical rams 60' are then extended (in supporting engagement with roof E) and the first vertical rams 60 are retracted (out of engagement with roof E) while the horizontal rams 65 are being retracted so that the first vertical rams 60' during contraction of the vertical rams 65, in which position they may provide further support for further advancement (sumping) of the cutting heads 10. When in their new position, of course, the vertical rams 60 are again extended so that they are in supporting engagement with the roof E during shearing by the cutting heads 10.

Figure 4:
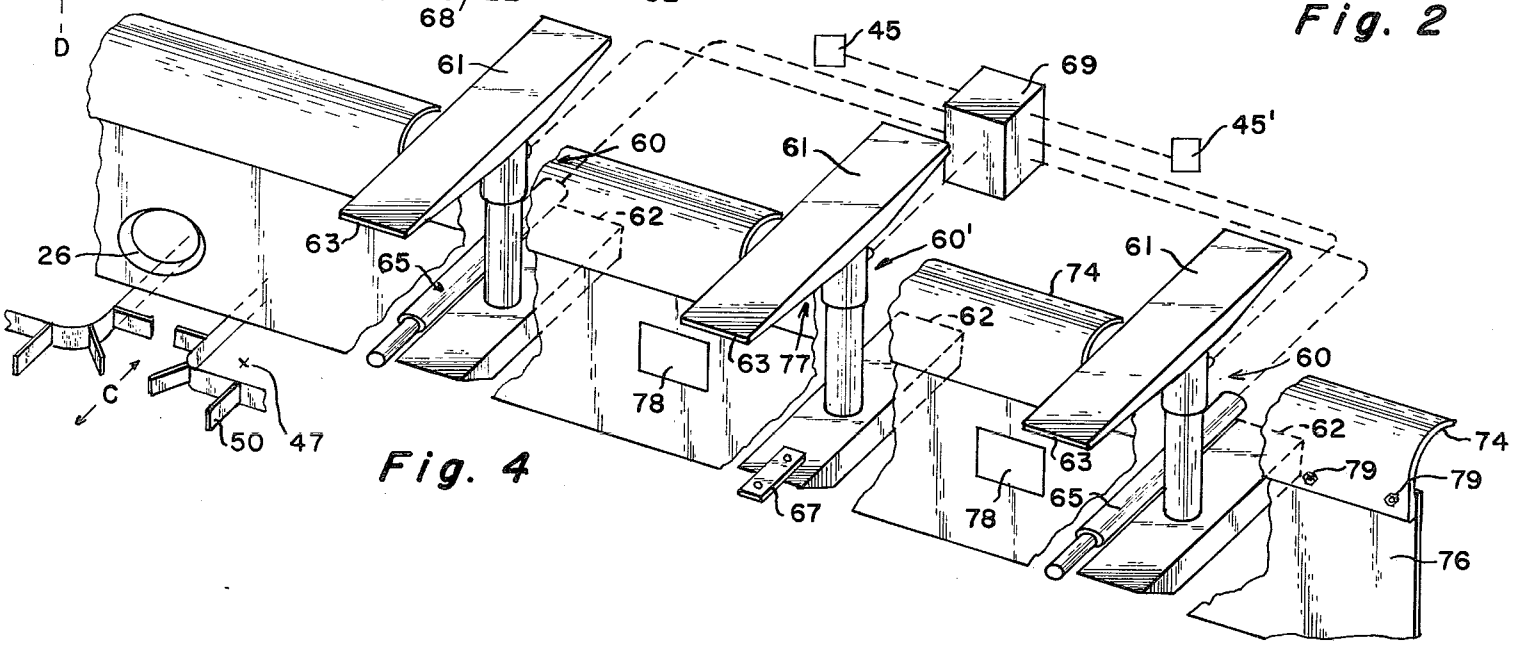
FIG. 4 is a schematic perspective view of the roof support and sumping means according to the present invention in operative relationship with the dust-containing means according to the present invention.

As shown in FIG. 4, the hydraulic control means 69 may also provide control for the reciprocating means 16 (cylinders 45,45') and suitable hydraulic or electrical circuitry and/or manual controls are provided for coordination between the operation of all the hydraulic assemblies. The hydraulic pump for powering all the hydraulic cylinders may also be integrally disposed with the control means 69 so that only an electrical cable (not shown) extends from the control means 69 away from the face B tc a source of power. Conveniently, the control means 69 may be mounted on the bottom 54 of chute 53, as shown diagrammatically in FIG. 2. In this way, a convenient power source is provided and the length of the hydraulic lines are minimized.

The means 24 associated with the supporting means 18 for containing dust generated by cutting into the confined area F adjacent the face B preferably includes a curtain assembly 75 including a solid, relatively rigid (i.e. steel or other metal) plate 76 affixed at the bottom thereof to the platform 47 and upstanding therefrom, and having a flexible (i.e. rubber) flap 74 attached to the top thereof for providing a seal with the roof E of the seam, and for allowing variation in seam thickness (allowing use of adjustable cutter member 34). Portions 74 of varying radius (and length) may be provided depending upon the height of the coal seam to be mined, and the flaps 74 may be attached to the plate 76 by readily releasable means (i.e. nuts and bolts 79). Openings 77 are provided in top portions of sealing flap 74 so that relative movement may take place between the rams 60' and the rams 60 without interfering with the curtain assembly 75. A plexiglas opening 78 or the like may be provided in the plate 76 to allow the operator to look into the confined area F. The curtain assembly 75 is so supported that the supporting elongated top portions 61 preferably have the tip portions 63 thereof within the confined area F. In this way, effective dust control can be provided while still supporting the roof E as close to the cutting heads 10 as possible — which supporting arrangement is extremely desirable.

Figure 5:
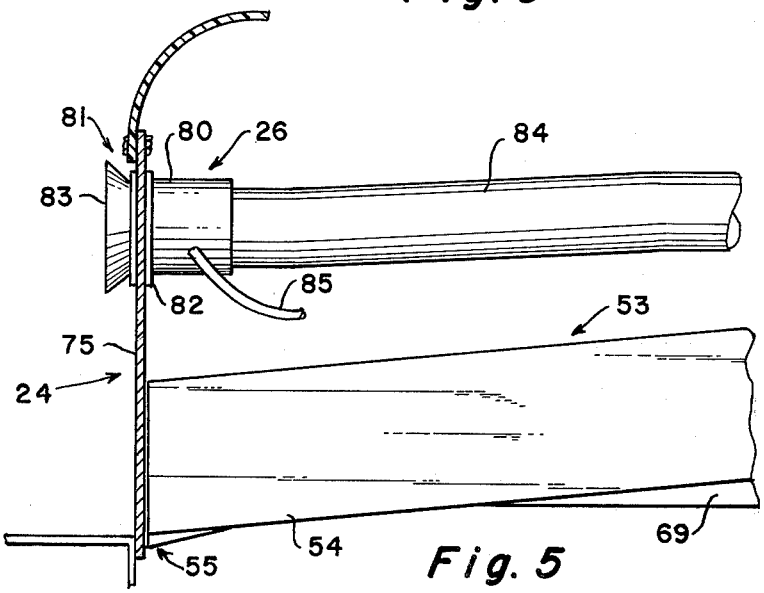
FIG. 5 is a detailed side view showing exemplary dust-containing means, according to the present invention, in cross-section, and showing exemplary dust exhaust means.

The means 26 for exhausting dust from the confined area F to an area for safe disposal of the dust preferably includes a suitable conventional exhaust fan 80 (such as an "AXE-VANE" fan), the fan 80 being mounted in an opening 81 in (see FIG. 5). Any suitable mounting bracket 82 may be provided for mounting the fan 80 in opening 81. The flared opening 83 allows dust to be drawn into fan 80 and is provided on one side of curtain assembly 75. Power is supplied to the fan 80 by an electrical cable 85 or the like, which cable 85 may run coextensively with cables extending to the motor 37 and the pump for the hydraulic control 69. While the drawings are shown with only one such fan 80, it is to be understood that enough fans 80 should be provided to provide adequate flow of air along the coal face B. Such a flow of air is necessary to conform to federal safety standards. Since the length of the face B being mined is preferably only about 16–30 (as distinct from long-wall mining), one fan 80 normally should be sufficient.

Figure 6:
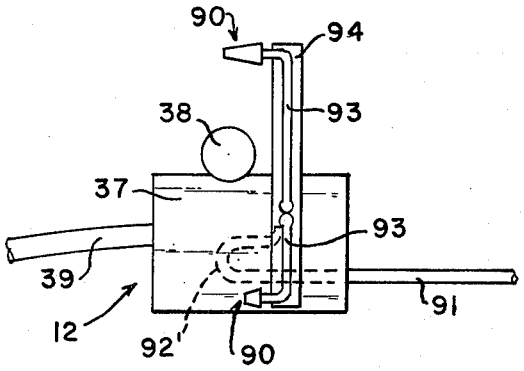
FIG. 6 is a top plan view of water-spraying means that may be associated with the miner of FIG. 1.

Control of dust within the confined area F also may be facilitated by nozzles 90 for spraying liquid into the confined area F (on the face B and in the area F, in general). Since motors 37 will have a tendency to get hot during operation, preferably a single structure may be provided for supplying liquid to the nozzles 90 and cooling the motors 37. A conduit 91 leading from a source of water at the rear of the miner passes into the casing for motor 37 and circulates around the motor (in passageway 92 shown in dotted line in FIG. 6), and then exits and provides liquid to lines 93 leading to nozzles 90. The lines 93 and nozzles 90 are shown mounted on a bracket 94 affixed to the top of the casing for a motor 37; however, the nozzles 90 may be mounted by any other suitable means and other nozzles 90 — not associated with motors 37 — may be spaced along the length of the shaft traversed by the cutting head when they are reciprocated.

Other accessory structures may be provided for cooperating with the components described above to effect proper cutting of coal or the like. For instance, flexible rubber tabs 95 may be provided mounted on opposite ends of plate 47 for providing sealing engagement between the side surfaces of the seam and the mounting means 14. Such flexible tabs 95 may be supported by vertically-extending rods 96 mounted on plates 47.

When the miner, according to the present invention, is advanced into the coal seam, roof supports preferably are provided just in back of vertically-adjustable rams 60, 60′ as the miner advances so that collapse of the roof E in back of the miner does not occur, but rather a through-passage is always provided to the rear of the miner for conveyance of the mined coal away from the face B, for providing a passage-way for cables extending to various portions of the miner, and for providing a safe area in which the operator of the miner may position himself. Diagrammatic representation of such supports are shown in dotted lines at 97 in FIGS. 1 and 2. Also, gas-monitoring means (shown in dotted lines at 98 in FIG. 3) may be provided in the confined area F for providing a warning when the gas levels exceed applicable standards and/or for automatically stopping operation of the motors 37 and the like and flashing a warning to the operator.

Apparatus according to the present invention having been described, an exemplary manner of operation thereof will now be set forth.

With the miner in the position shown in FIG. 2, the controls 69 are actuated to retract rams 60′ while extending rams 65, thereby sumping the cutting heads 10, the cutting heads 10 being powered by electric motor 37 through chain drive 33 and cutting their way into the face B during sumping. Once the desired penetration has been achieved (about the length of the piston portion of rams 65), the control means 69 are actuated so that the rams 60′ are extended, the rams 60 are retracted, and the rams 65 are retracted whereby the rams 60 again assume the relative position with respect to the miner shown in FIG. 2. The rams 60 are then again extended to perform their supporting function for the roof E and to anchor the mounting means 14 during subsequent reciprocation of the heads 10.

Once the desired penetration of face B has been made, the control means 69 actuate the hydraulic motors 45 to gradually draw the rotating heads 10 towards each other, the heads shearing the coal from face B as they are drawn together (or moved apart), the heads ultimately stopping when they assume the dotted line position shown in FIG. 1. During this shearing, the paddles 50 of the conveying means 20 are continuously driven by the drive means 50 so that the cut coal is moved towards the middle passageway C, into the chute 53, and away from the face B substantially perpendicular thereto. The coal is ultimately carried away through the cut seam previously formed by the miner. During the entire cutting operation, the curtain assembly 75 prevents any substantial quantity of dust from exiting the confined area F, and the dust is continuously withdrawn from the area F by the exhaust fan 80. Since the supporting portions 61 of the rams 60, 60′ extend partially into the confined area F, suitable dust control may be provided while also insuring sufficient support of the roof E. Also, during the shearing operation, water is sprayed by nozzles 90 into the area F to assist in controlling the dust therein. Once the cutting heads 10 have made a complete reciprocation, they are maintained in the longitudinal position to which they are moved, and then after sumping are reciprocated to shear in the other direction. Suitable root supports 97 having been provided in back of the miner in order to prevent collapse of the cut seam behind the miner, the miner is then ready for another sumping operation to further advance into the coal seam.

It will be seen that according to the present invention a miner especially adapted for low coal seams (seams 24–36 inches thick) has been provided which effects efficient cutting action, allows the coal to be continuously conveyed from the cutting area perpendicular to the cutting face for ultimate use, provides excellent support for the roof of the seam (as close to the cutting face as possible during cutting), and provides for effective dust control in the cutting area. Thus, it will be seen that the miner, according to the present invention, can comply with present mining safety standards while allowing high production of coal.

While the invention has been herein shown and described in what is presently conceived to be the most preferred embodiment of the invention, it will be apparent to those of ordinary skill in the art that many modifications may be made thereof within the scope of the invention, which scope is to be accorded the broadest interpretation of the appended claims in order to encompass all equivalent structures and devices.

What is claimed is:

1. A full face miner for mining coal in a seam, comprising:

a. a pair of cutting heads each rotatable about a vertical axis, the vertical axes being parallel to each other and longitudinally spaced from each other along the face of coal to be mined;

b. means for rotating each of said cutting heads about its vertical axis for effecting cutting, each head rotating toward the other head;

c. means mounting said cutting heads for reciprocal longitudinal movement toward and away from each other, to effect shearing, along the coal face;

d. means for moving said cutting heads on said mounting means in reciprocal longitudinal movement to effect shearing;

e. means for supporting the roof of the cut seam and for anchoring said mounting means in stationary position within the seam during reciprocal movement of said cutting heads with respect to said mounting means;

f. a pair of paddle-type conveyors associated with said mounting means, one for each cutting head, for conveying coal cut from said coal face by said cutting heads away from said coal face; and g. means for sumping said cutting heads.

2. A miner as recited in claim 1 further comprising a cutting member vertically extensible from each of said cutting heads at the top portions thereof for providing adjustment of the height of the face that is being cut.

3. A miner as recited in claim 1 wherein said anchoring and supporting means comprising a plurality of vertically adjustable rams having elongated portions at the top and bottom thereof for engaging the roof and floor of said seam, said rams being operatively connected to said mounting means.

4. A miner as recited in claim 3 wherein said means for sumping said cutting heads comprises a plurality of horizontally adjustable rams secured to said mounting means and to first vertical rams which comprise some of said vertically adjustable rams.

5. A miner as recited in claim 4 wherein second vertical rams, comprising some of said vertically adjustable rams distinct from said first vertical rams, are connected to said mounting means by horizontal connecting members.

6. A miner as recited in claim 5 further comprising hydraulic control means for controlling said vertically adjustable rams and said horizontally adjustable rams so that said second vertical rams are retracted and said horizontal rams extended while said first vertical rams remain extended and in anchoring position to provide advancement of said cutting heads a given distance, and said second vertical rams extended and said first vertical rams are retracted while said horizontal rams are being retracted so that said first vertical rams are advanced into a position wherein by extension of said horizontal rams said cutting heads may be again advanced.

7. A miner as recited in claim 3 further comprising means for substantially containing dust generated by cutting in a confined area adjacent said cutting face while allowing disposition of said supporting means as close to said cutting heads as possible.

8. A miner as recited in claim 7 wherein said containing means comprises a curtain assembly including a rigid plate upstanding from said cutting head mounting means and a flexible sealing member being provided on the top of said plate for engaging the seam roof.

9. A miner as recited in claim 8 further comprising means for exhausting dust from said confined area and leading it to an area of safe disposal, said means including an exhaust fan operatively mounted in said plate and having exhaust tubing extending therefrom to a safe disposal area.

10. A miner as recited in claim 1 wherein said means for rotating said cutting heads comprises an electric motor associated with each cutting head, mounted on said mounting means, and longitudinally reciprocal with its respective cutting head.

11. A miner as recited in claim 10 further comprising means for spraying liquid on and adjacent the face to facilitate dust control, said spraying means including a liquid conduit passing through an electric motor for cooling said motor.

12. A miner as recited in claim 1 further comprising means for driving each of said paddle-type conveyors so that cut coal or the like is moved toward a conveying passage disposed substantially longitudinally intermediate said cutting heads and extending substantially perpendicular to said cutting face and so that the cut coal is conveyed along said passage by said conveyors, each of said paddle-type conveyors having a closed loop configuration.

13. A miner as recited in claim 1 wherein said means for moving said cutting heads on said mounting means comprises a pair of hydraulic motors, one associated with each cutting head, a chain driven by each of said hydraulic motors, and means connecting each of said chains to a cutting head.

14. A full face miner for mining coal in a seam comprising:

a. a cutting head rotatable about a vertical axis, said cutting head including a cutting member rotatable about said vertical axis and vertically extensible from said cutting head at a top portion thereof for providing adjustment of the height of the face that is being cut;

b. means for rotating said cutting head about its reciprocal axis for effecting cutting;

c. means mounting said cutting head for reciprocal longitudinal movement along the face of coal to effect shearing;

d. means for moving said cutting head on said mounting means in reciprocal longitudinal movement to effect shearing;

e. conveying means for conveying cut coal away from said face;

f. means for sumping said cutting head;

g. means located as close to said cutting head as possible for supporting the roof of the cut seam while anchoring said mounting means during reciprocal movement of said cutting head;

h. means for substantially containing dust generated by cutting into a confined area adjacent said face; and i. means for exhausting dust from said confined area to an area for safe disposal of the dust.

15. A full face miner for mining coal in a seam, comprising:

a cutting head rotatable about a vertical axis;

means for rotating said cutting head about its vertical axis for effecting cutting;

means mounting said cutting head for reciprocal longitudinal movement along the face of coal to effect shearing;

means for moving said cutting head on said mounting means in reciprocal longitudinal movement to effect shearing;

conveying means for conveying cut coal away from said face;

means for sumping said cutting head;

means located as close to said cutting head as possible for supporting the roof of the cut seam while anchoring said mounting means during reciprocal movement of said cutting head;

means for substantially containing dust generated by cutting into a confined area adjacent said face;

means for exhausting dust from said confined area to an area for safe disposal of the dust;

an electric motor mounted on said mounting means and longitudinally reciprocal with said cutting head; and means for spraying liquid into the confined area to facilitate the control of dust generated by cutting, said spraying means including a liquid conduit passing through said electric motor for cooling said motor.

16. A full face miner for mining coal in a seam, comprising:

a cutting head rotatable about a vertical axis;

means for rotating said cutting head about its vertical axis for effecting cutting;

means mounting said cutting head for reciprocal longitudinal movement along the face of coal to effect shearing;

means for moving said cutting head on said mounting means in reciprocal longitudinal movement to effect shearing;

conveying means for conveying cut coal away from said face;

means for sumping said cutting head;

means located as close to said cutting head as possible for supporting the roof of the cut seam while anchoring said mounting means during reciprocal movement of said cutting head, means for substantially containing dust generated by cutting into a confined area adjacent said face;

means for exhausting dust from said confined area to an area for safe disposal of the dust;

said roof supporting and anchoring means comprising a plurality of vertically adjustable rams having elongated portions at the top and bottom thereof for engaging the roof and floor of the seam, said rams being operatively connected to said mounting means and a portion of said elongated top portions thereof being disposed within the confined area;

said containing means comprising a curtain assembly including a rigid plate upstanding from said cutting head mounting means and a flexible material sealing member provided on the top of said plate for engaging the seam roof; and said exhausting means comprising an exhaust fan operatively mounted in said plate and having exhaust tubing extending therefrom to a safe disposal area.

* * * * *